US011097150B2

(12) United States Patent
Duke

(10) Patent No.: US 11,097,150 B2
(45) Date of Patent: Aug. 24, 2021

(54) THREE-DIMENSIONAL ROCKING CHAIR WITH VARIABLE CURVATURE BASE FOR ABDOMINAL EXERCISE

(71) Applicant: John Hincks Duke, Providence, RI (US)

(72) Inventor: John Hincks Duke, Providence, RI (US)

( * ) Notice: Subject to any disclaimer, the term of this patent is extended or adjusted under 35 U.S.C. 154(b) by 0 days.

(21) Appl. No.: 16/510,937

(22) Filed: Jul. 14, 2019

(65) Prior Publication Data

US 2020/0016456 A1 Jan. 16, 2020

Related U.S. Application Data

(60) Provisional application No. 62/698,043, filed on Jul. 14, 2018.

(51) Int. Cl.

| | |
|---|---|
| ***A63B 21/00*** | (2006.01) |
| ***A63B 23/02*** | (2006.01) |
| ***A47C 3/029*** | (2006.01) |

(52) U.S. Cl.

CPC ..... *A63B 21/4027* (2015.10); *A47C 3/029* (2013.01); *A63B 21/4039* (2015.10); *A63B 23/0216* (2013.01); *A63B 21/0004* (2013.01); *A63B 2208/0228* (2013.01)

(58) Field of Classification Search

CPC ..... A63B 21/0004; A63B 21/4027; A63B 21/4039; A63B 2208/0228; A63B 2208/0233; A47C 9/002; A47C 9/005; A47C 3/02; A47C 3/025; A47C 3/027; A47C 3/029; A47D 13/00; A47D 13/102

See application file for complete search history.

(56) References Cited

U.S. PATENT DOCUMENTS

| | | | | |
|---|---|---|---|---|
| 3,041,070 A | | 12/1958 | Kerstein | |
| 3,899,208 A | * | 8/1975 | Cirigliano | A47C 3/029 297/271.5 |
| 4,084,273 A | | 4/1978 | Hayes | |
| 4,595,234 A | | 6/1986 | Kjersem | |
| 5,375,911 A | * | 12/1994 | Morrow | A47C 3/029 297/271.5 |

(Continued)

*Primary Examiner* — Garrett K Atkinson
*Assistant Examiner* — Zachary T Moore

(57) ABSTRACT

An omnidirectional rocking chair for abdominal exercise has a rectangular support base with a convex lower support surface with variable radii of curvature. The chair back supports only the user's lower back. Rocking the chair develops outward momentum in the mass of the user's upper back, arms and head. The minimum lower support surface radius of curvature is in its central portion and the center of that curvature is above the center of gravity of the seated user and chair. The peripheral portions of the lower support surface have larger radii of curvature. The corner portions of the lower support surface have maximum radii of curvature. The effect of progressive increase in support surface radius of curvature is to increase righting moment in the rocking motion where the respective larger radii portions contact the floor. This acts to decelerate outward rocking motion in the chair seat and user's lower back in opposition to the developed outward momentum in the mass of the user's upper back, arms, and head, which engages user abdominal trunk muscles.

1 Claim, 4 Drawing Sheets

(56) References Cited

U.S. PATENT DOCUMENTS

| | | | | |
|---|---|---|---|---|
| 5,605,526 | A * | 2/1997 | Hatfield | A47C 3/029 482/129 |
| 5,643,165 | A | 7/1997 | Klekamp | |
| 5,887,944 | A | 3/1999 | Boost | |
| 7,494,446 | B2 | 2/2009 | Weck et al. | |
| 9,586,084 | B2 * | 3/2017 | Duke | A63B 21/00072 |
| 2003/0164633 | A1 | 9/2003 | Jakus et al. | |
| 2006/0061195 | A1 * | 3/2006 | Snyders | A47C 3/029 297/452.63 |
| 2007/0149372 | A1 * | 6/2007 | Zhang | A63B 21/0004 482/140 |

* cited by examiner

THREE-DIMENSIONAL ROCKING CHAIR WITH VARIABLE CURVATURE BASE FOR ABDOMINAL EXERCISE

This application claims priority based upon U.S. Provisional Application Ser. No. 62/698,043 filed Jul. 14, 2018.

BACKGROUND OF THE INVENTION

The present invention relates to rocking chairs and abdominal exercise apparatus. In the prior art of rocking chairs, it is long known that it is the arcuate form of the rockers contacting a floor that provides the characteristic rhythmical user experience. Here the vertical distance between the seated user center of gravity and the rocker center of curvature functions as a pendulum with a specific natural frequency of oscillation. This is how rocking chairs continue to rock back and forth between user actuations, as does a swinging pendulum. The continuity of this motion is what adds valuable vestibular stimulation to the user experience.

The object of the chair invention disclosed here is to provide an exercise means to maintain or improve abdominal core strength in a low-intensity, comfortable, and secure way. Chronic lower back pain and increased fall risk with age have significant negative impacts on quality of life. Exercises to increase abdominal core strength are known to mitigate both. The chair's enjoyable natural rocking rhythm with vestibular stimulation makes the exercise easier to perform for long periods of time, for example while watching television. For infirm persons, it may be performed without constant professional assistance once seated.

The improvement of the present invention is in the particular form of a three-dimensional chair base that can rock in all directions, with distinct radii of curvature in the central, peripheral and corner portions.

In the prior art, U.S. Pat. No. 5,887,944 to Boost discloses a chair with a round base and a ballast member under the seat. The ballast member prevents the chair from tipping over during use. U.S. Pat. No. 3,041,070 to Kerstein discloses a hemispherical shell compartment for multiple users, also with ballast to keep the shell upright. U.S. Pat. No. 4,084,273 to Hayes disclosed a playpen for children with a round spherical base. The round and hemispherical base shapes of these inventions also rock in all directions, but do not have distinct radii of curvature in the central, peripheral and corner portions.

In a non-chair balancing device, U.S. Pat. No. 7,494,446 to Weck et al. discloses a spherical bladder attached to a platform, the so-called "BOSU BALL". Users may invert this devise and stand upon the platform with the spherical bladder contacting the floor. In this position the devise is inherently unstable and requires dynamic user body control to keep upright, and so is not suitable for long duration exercise sessions.

U.S. Pat. No. 4,595,234 to Kjersem discloses a chair base with two straight sections at an angle to each other and a fulcrum portion between them. A user may tip the chair to rest upon one section or the other, but this action does not provide a continuous rocking motion with a natural frequency of oscillation.

The related prior art also includes tipping devices with circular bases as disclosed in U.S. Pat. No. 5,643,165 to Klekamp and US Pat. Appl. 2003/01646633A by Jakus et al. These have in common a round base platform with a central downward projection. A user may tip them from one side of the base platform circumference to another, or roll around the central projection so the central vertical axis sweeps a conical path. These devices also do not provide the aesthetic benefit of a natural rocking motion.

U.S. Pat. No. 9,586,084 to Duke discloses a rocking chair with conventional two dimensional motion with rockers with an increased radius of curvature only in their rear portions.

SUMMARY OF THE INVENTION

The chair of the present invention supports only the user's lower back, and has a preferably rectangular base to enable a three dimensional rolling motion rather than the two dimensional motion in the longitudinal plane of a conventional rocking chair. The lower base surface has a distinct variable radius of curvature shape. First, the minimum base radius of curvature is in the central portion. Here the height of the center of this minimum radius of curvature is above the center of gravity of the seated user and chair, which provides an integral positive righting moment without added ballast. Second, the form of the base transitions smoothly to a larger radius of curvature outside the central portion, which progressively increases the chair righting moment with greater angles of inclination in all directions. Within this portion, the radii of curvature in the transverse sectors is less than in the forward and rear sectors. Lastly, the maximum radius of curvature is in the corner portions of the base rectangle. When a user rolls forward and back along a side portion of the base, this provides an increase in transverse righting moment when the corner portions of the chair base contact the floor.

In operation, the above low righting moment in the central portion facilitates initiation of rolling motion by some user body movement. This develops momentum in the user's upper body. The above progressive peripheral increase in righting moment then decelerates that rocking motion. This deceleration is translated from the chair seat to the user's lower back. The user's abdominal trunk muscles are then engaged in translating that deceleration from the user's lower back to the user's upper back. This abdominal trunk muscle engagement is an isometric reaction type without potentially injurious large angle spinal flection. The above increase in transverse righting moment when the corner portions of the chair base contact the floor has a particular benefit in strengthening lateral abdominal muscles, which are critical to user fall prevention reflexes.

DESCRIPTION OF THE PREFERRED EMBODIMENT

Figure 1:
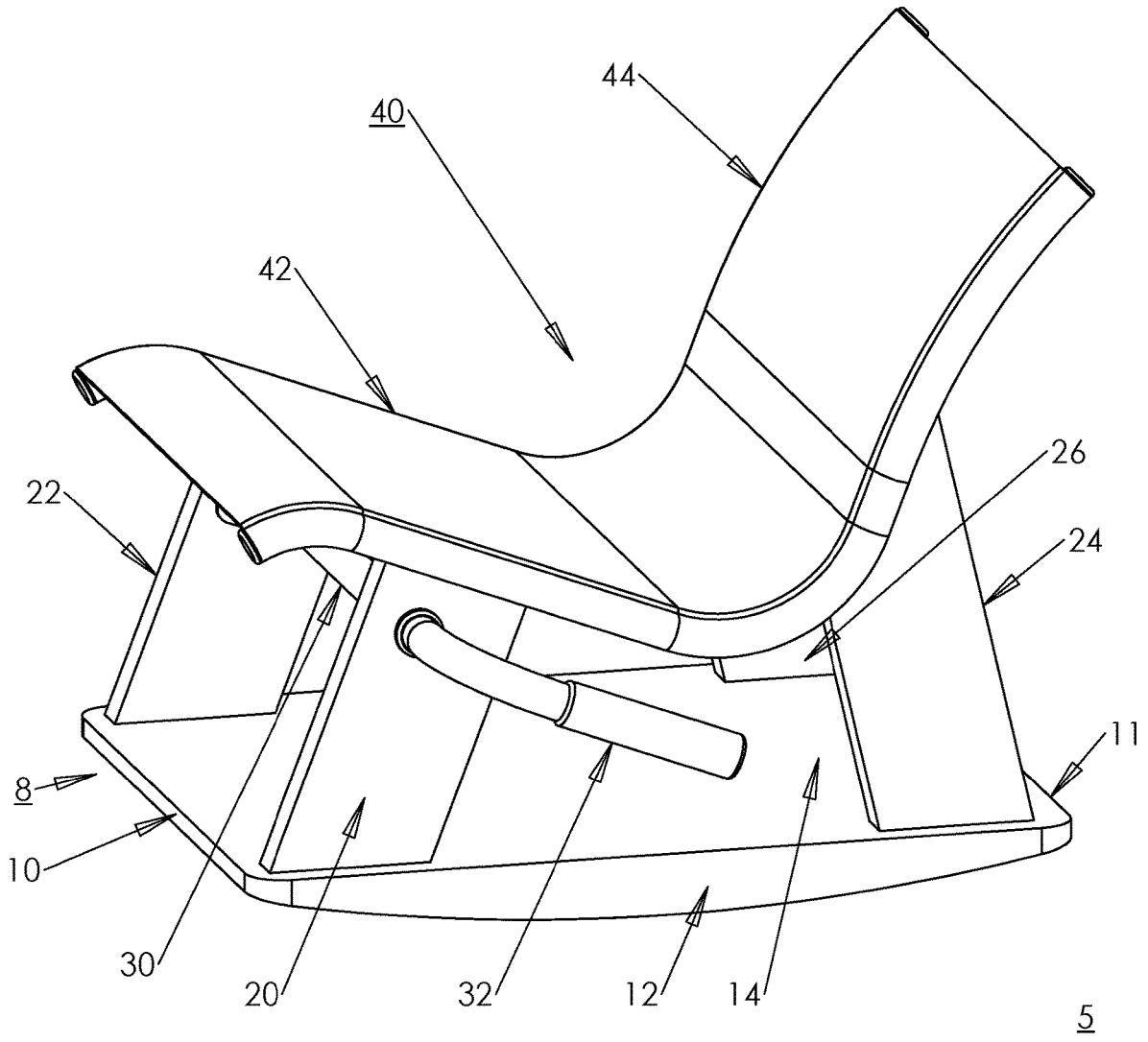
FIG. 1 is a side perspective view of the chair.

FIG. 1 shows a perspective view of the chair with a floor 5 upon which a base 8 rests. Base 8 has a forward end 10, an aft end 11, a left side 12, a right side 13 not shown, an upper base surface 14 and a lower base surface 15 not shown. Upper surface 14 supports a forward left leg 20, a forward right leg 22, an aft left leg 24, and an aft right leg 26. A transverse handle tube 30 projects through an upper portion of forward left leg 20 and an upper portion of forward right leg 22. The left end of handle tube 30 supports a left hand grip 32 and the right end of handle tube 30 supports a right hand grip 34 not shown. The upper ends of legs 20, 22, 24, and 26 support a user body support surface 40 with a seat portion 42 and back portion 44.

Figure 2:
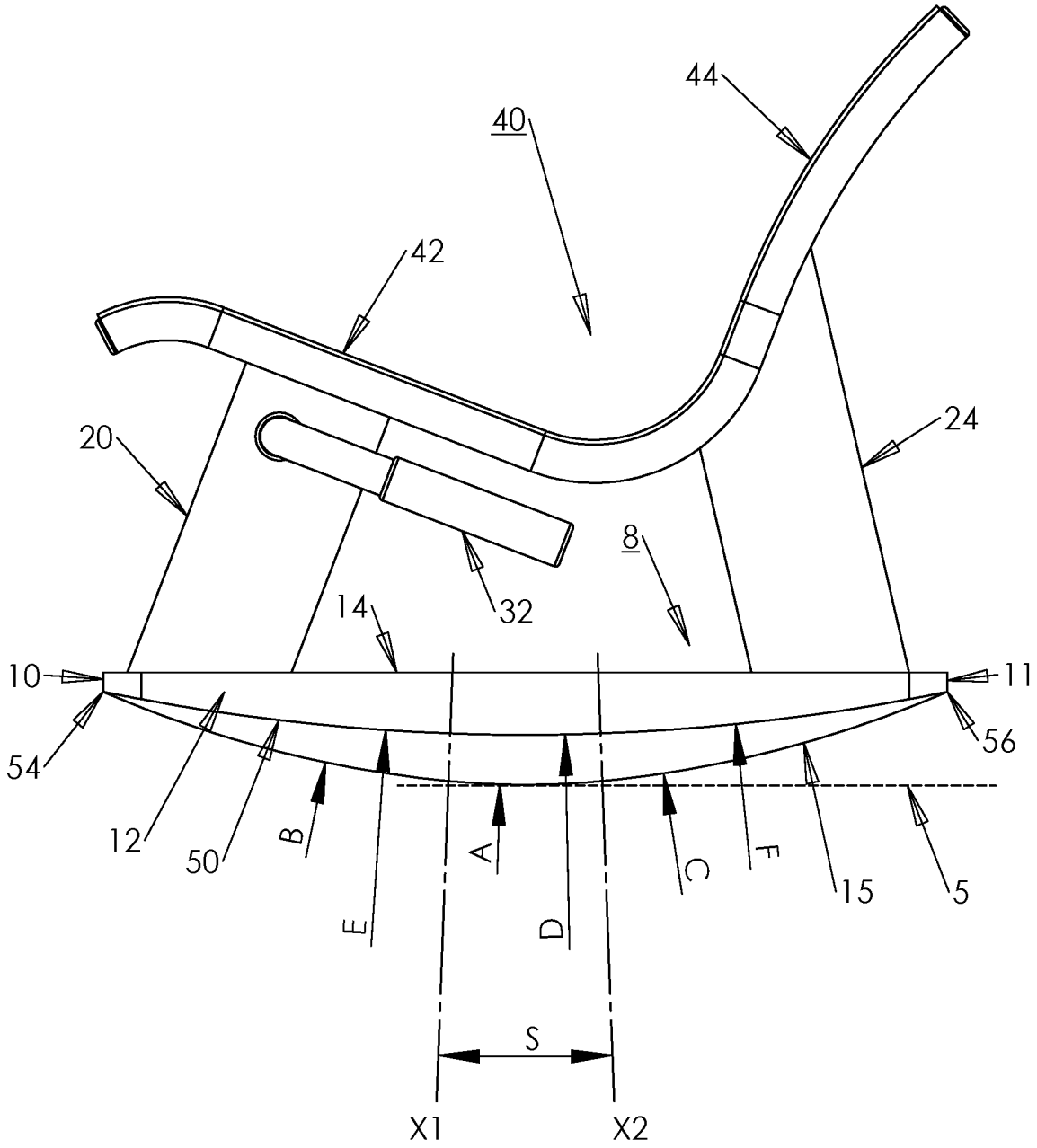
FIG. 2 is a side elevation view.

FIG. 2 is a left side view of the invention further showing lower base surface 15. A forward chine 54 is at the intersection of front end 10 and lower base surface 15. An aft chine 56 is at the intersection of aft end 11 and lower base surface 15. The side projection of lower base surface 15 is a compound curve tangent to floor 5. The longitudinal axes of hand grip 32 and hand grip 34 not shown are substantially parallel to the plane of seat portion 42. The plane of seat portion 42 is inclined upward-forward at an angle of approximately 21 degrees with respect to upper base surface 14. The lower section of back portion 44 is inclined upward-aftward approximately perpendicular to seat portion 42, and the upper section of back portion 44 curves convexly aftward to follow the lordosis curve of the lumbar region of the back of a typical user. The upper extent of the back portion 44 is approximately to the top of the lumbar region of the back of a typical user. The thoracic region of the back of a typical seated user therefore extends above the top of back portion 44.

FIG. 2 further shows the side view projection of the forward-aft complex curvature of lower base surface 15, where the tangent contact between lower base surface 15 and floor 5 is within a central segment of lower base surface 15 bound by a pair of radial rays X1 and X2. The position of user body support surface 40 is such that the center of gravity of a seated user with feet held above floor 5 is substantially above this central segment of lower base surface 15. An angle S is the angle between rays X1 and X2. A radius A is the radius of curvature of the forward-aft silhouette of lower base surface 15 within the segment bound by rays X1 and X2. Rays X1 and X2 originate at the center of radius A. A radius B is the radius of curvature of the forward-aft silhouette of lower base surface 15 forward of ray X1. A radius C is the radius of curvature of the forward-aft silhouette of lower base surface 15 aft of ray X2. The length of radius A is less than the lengths of radii B and C. The portion of lower base surface 15 bound by rays X1 and X2 is tangent to both the adjacent portion forward of ray X1 and the adjacent portion aft of ray X2. A left chine 50 is the intersection of left side 12 and lower base surface 15. A right chine 52 not shown is the intersection of right side 13 and lower base surface 15. Left chine 50 and right chine 52 are substantially symmetric with respect to the chair's forward-aft vertical centerline plane. A radius D is the radius of curvature of chine 50 within the segment bound by rays X1 and X2. A radius E is the radius of curvature of chine 50 forward of ray X1. A radius F is the radius of curvature of chine 50 aft of ray X2. The length of radius D is less than the lengths of radii E and F. Transversely, the length of radius A is less than the length of radius D, the length of radius B is less than the length of radius E, and the length of radius C is less than the length of radius F.

Figure 3:
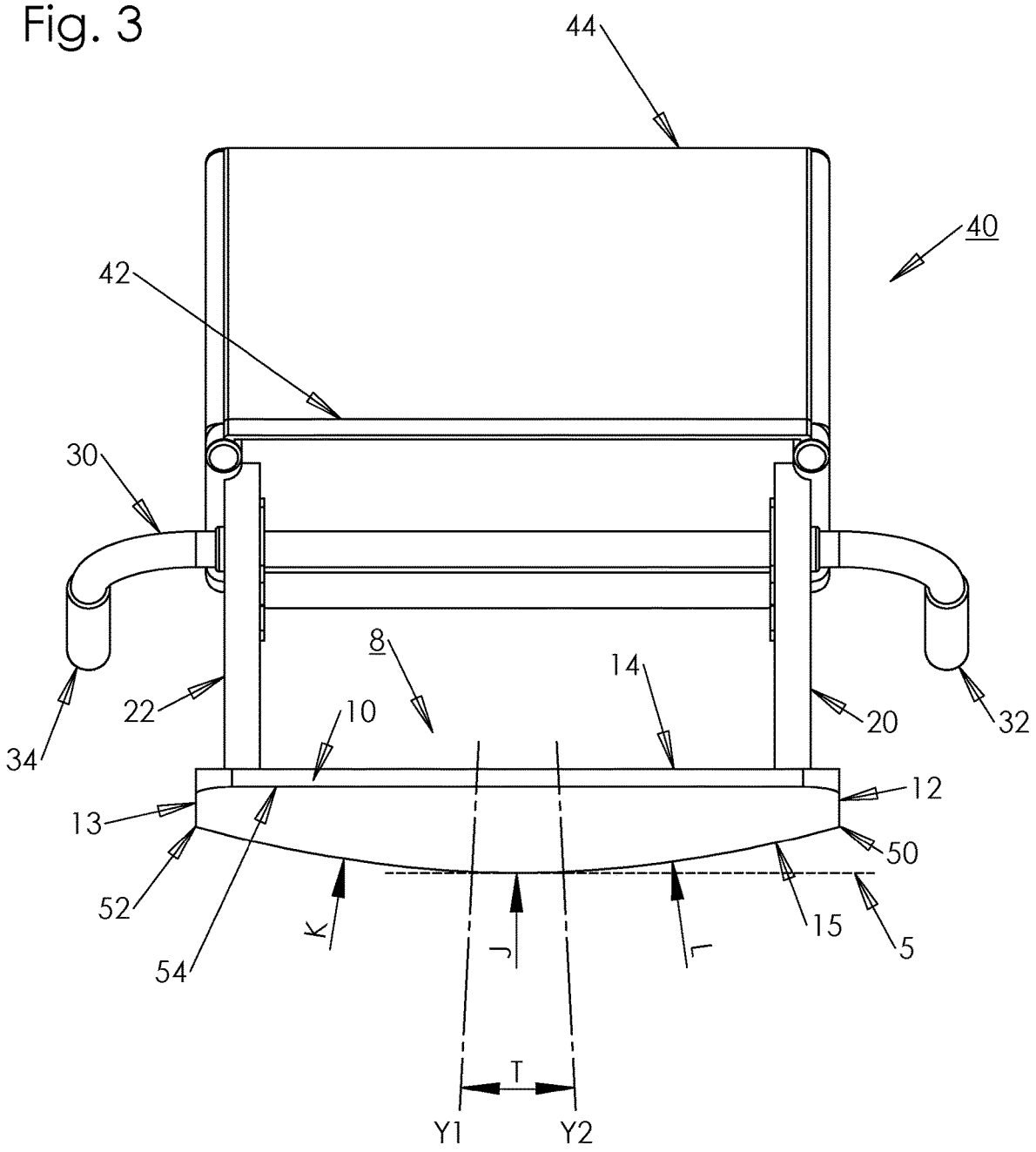
FIG. 3 is a front elevation view.

FIG. 3 is a front view further showing right base side 13, right hand grip 34, and right chine 52. The front projection of base 8 shows the transverse complex curvature of lower base surface 15, where a central segment of lower base surface 15 is bound by a pair of radial rays Y1 and Y2. An angle T is the angle between rays Y1 and Y2. A radius J is the radius of curvature of the transverse silhouette of lower base surface 15 within the segment bound by rays Y1 and Y2. Rays Y1 and Y2 originate at the center of radius J. A radius K is the radius of curvature of the transverse silhouette of lower base surface 15 rightward of ray Y1. A radius L is the radius of curvature of the transverse silhouette of lower base surface 15 leftward of ray Y2. Radius K is substantially equal to radius L. The length of radius J is less than the lengths of radii K and L. The portion of lower base surface 15 bound by rays X1 and X2 is tangent to both the adjacent portion rightward of ray Y1 and the adjacent portion leftward of ray Y2. Chine 54 and chine 56 are substantially straight.

In the preferred embodiment radius A is less than radius J and angle S is greater than angle T.

Figure 4:
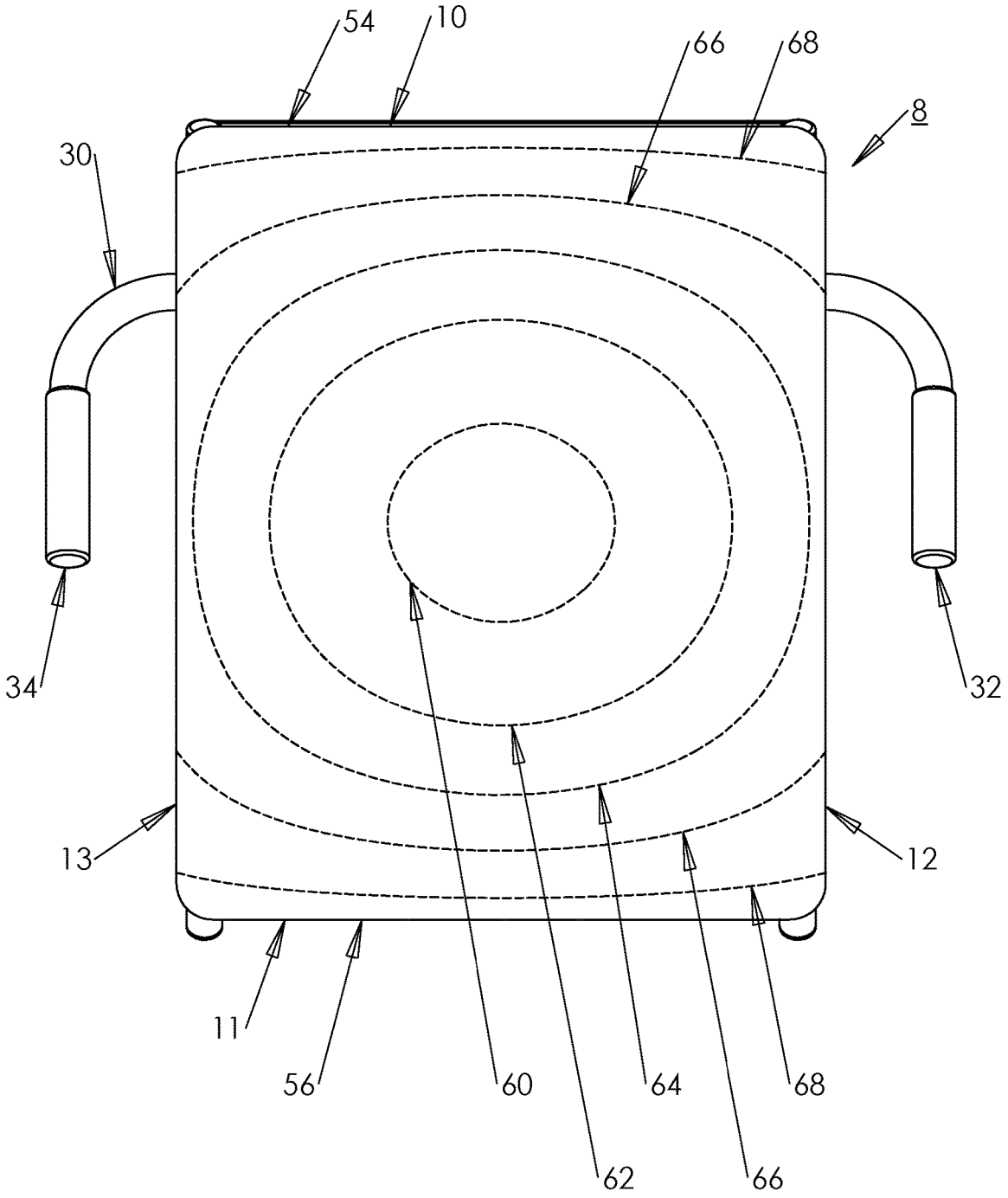
FIG. 4 is a bottom view with equal vertical interval contour lines mapping the bottom surface.

FIG. 4 shows a bottom view of the chair with a series of dashed equal vertical interval contour lines 60, 62, 64, 66, and 68 on lower base surface 15. In the central lower portion of lower base surface 15, contour lines 60 and 62 are elongated transversely, reflecting the relation of radius A less than radius J. Next upward, contour line 64 transitions to a quasi-rectangular form with straighter longitudinal and straighter transvers portions. Further upward, contour lines 66 and 68 intersect base sides 12 and 13 and are progressively straighter closer to chines 54 and 56. Contours 60, 62, 64, 66, and 68 indicate how, in the preferred embodiment, the fabrication of lower base surface 15 is a lofted three dimensional shape that conforms to the particular side and front projection views shown in FIG. 2 and FIG. 3 respectively. Those views show tangent transitions from distinct smaller radii of curvature in the central portion of lower base surface 15 to larger radii of curvature in the peripheral portions. In an alternative embodiment, the form of lower base surface 15 may be specified as a blended loft of continuously variable radii of curvature.

In the preferred embodiment, the lowest portion of body support surface 40 is nine inches above floor 5, and the above measures of the complex curvature of base surface 15 are as follows: Angle S equals twelve degrees, radius A equals twenty-one inches, radii C and B equal thirty inches, radius D equals 53 inches, radii E and F equal fifty-five inches, angle T equals 6 degrees, radius J equals 25 inches, and radii K and L equal 35 inches.

In the preferred mode of operation, a user sits upon support surface 40 and extends her or his legs to hold her or his heels above floor 5. In that stationary position, upper base surface 14 is substantially horizontal and the point of tangent contact between lower base surface 15 and floor 5 is within the area of base surface 15 bounded longitudinally between rays X1 and X2 and transversely between rays Y1 and Y2, as shown in FIGS. 2 and 3. While a user is comfortable is this stationary position, there is an isometric exercise benefit in supporting the cantilever loads of his or her leg extension forward of seat portion 42 and his or her thoracic back extension aft of the top end of the inclined back portion 44.

A user then acts to shift her or his center of gravity horizontally. This action may result from one or a combination of the following motions: Tipping the head forward, aftward or sideward, extending one or both arms forward, aftward or sideward, retracting the legs, swinging one or both legs sideward, flexing the abdominal muscles to pull the upper body forward, grasping hand grips 32 and 34 and exerting a same direction horizontal or vertical force to which the upper body reacts by tipping forward, aftward or sideward, and grasping hand grips 32 and 34 and exerting respective opposing horizontal or vertical forces, which develops a force couple to which the upper body reacts by tipping forward, aftward or sideward. Because the radius of curvature of lower base surface 15 is smallest within its central portion bound by rays X1, X2, Y1, and Y2, the above shift in user center of gravity easily initiates a chair rocking motion of lower base surface 15 upon floor 5 away from the above initial stationary position. This chair rolling motion then develops forward, aftward, or sideward horizontal momentum in the user's upper body mass above the top of seat back 44.

Next, the above chair rolling motion shifts the point of tangent contact between base surface 15 and floor 5 to a peripheral portion where the radius of curvature of base surface 15 is greater than within the central portion bound by rays X1, X2, Y1, and Y2. This larger peripheral radius of curvature increases the gravitational righting moment on the chair, which is a restoring force that acts to arrest the above forward, aftward, or sideward rolling motion. This increased restoring force translates from the chair to the user's lower body through the body's sitting connection to support surface 40. At this moment, one or more of the user's abdominal core muscles then contract to translate this increased restoring force from the user's lower body to the user's upper body. This abdominal core muscle engagement is greater than it would be if the curvature of lower base 15 were constant. In this way, a first benefit of the chair's variable curvature base is increased abdominal muscle engagement in upper body mass deceleration.

Human muscles react dynamically as springs. In the above initial chair roll, after the forward, aftward or sideward upper body momentum has been opposed, the same muscle contraction causes a small angle deflection of the user's abdomen in the opposite direction, which then shifts the user's center of gravity to initiate the next roll in the opposite direction. In this way, a second benefit of the chair's variable curvature base is to help establish a rhythmical cycle of to and fro rolling, which is inherently enjoyable.

A third benefit of the chair's variable curvature base is the consequent restriction of the amplitude of the above to and fro rolling cycle, which enhances actual and perceived user security in the chair.

The above listed multiple means by which a user may shift her or his center of gravity, combined with the freedom to roll the chair in any direction, provide a diverse set of potential exercise routines.

A particular exercise that benefits from the chair's variable curvature base results in a quasi-rectangular motion about the chair's vertical axis. Here there is a particular benefit in lateral trunk muscle engagement due to the reduction in lower base 15 curvature adjacent to forward end 10 and aft end 11, near where chines 54 and 56 are straight. In this mode of operation, the user initially tips the chair to a first side, and then initiates a rocking motion along that side. The transverse radius of curvature along the sides is less at the ends of the base than in its midsection, as radii K and L transition to straight chines 54 and 56. Therefore, when rocking along one side, as the user's forward or aftward motion stops, the radius of curvature of lower base 15 at its point of contact with floor 5 is less in the transverse direction than in the forward-aft direction. This results in an abrupt reverse tip to the opposite side, which engages the lateral core muscles to accelerate the user's upper body towards the opposite side. The return longitudinal rocking motion is then veers to that opposite side. Continuation of this exercise results in a quasi-rectangular motion. The user may alternate this cycle in clockwise and counter-clockwise directions with or without use of handles 32 and 34.

The chair primarily engages abdominal core muscles to oppose horizontal momentum in the user's upper body that results from the chair's rolling motion. This has a significant advantage to persons with spinal injuries or back pain, because it does not require large angle spinal flexure and the user's vertebrae remain within their neutral zone of relative motion. The spine as a whole moves with the chair. This is in contrast to crunch type exercises in which the abdominal muscles act to bend the spine. A related advantage of this mode of core engagement is in fall prevention. Here the controlled rolling motion of the whole upper body in the chair is geometrically similar to sway in a person's upper body that may presage a fall. In using the chair, the neurological pathways that act to stabilize the spine are repeatedly used to resist the rolling induced upper body momentum. These are the same neurological pathways activated in balance keeping reflexes. In these ways, the chair both strengthens muscles needed to keep balance and trains the neurological reflexes that activate them.

A further engagement of a user's abdominal core muscles is in the abdominal reaction to arm extension and contraction when pulling or pushing on hand grips 32 and 34.

What is claimed is:

1. An exercise chair comprising:

a seat with a front end towards which a seated user faces, an opposite aft end, a left side, and a right side, and a base that is rectangular, wherein the base has a convex complexly curved lower surface that gravitationally bears upon a floor surface in use, wherein the center of gravity of the chair and the seated user is above a central portion of the lower base surface, wherein the central portion of the lower base surface has a first radius of curvature with a center of curvature that is above the center of gravity of the chair and seated user, wherein portions of the lower base surface surrounding the central portion have radii of curvature greater than said first radius of curvature, wherein portions of the lower base surface where lower base surface ends and lower base surface sides meet have the maximum radii of curvature, wherein a form of said lower base surface is such that its adjacent portions with differential radii of curvature are mutually tangent, and wherein a set of intersections between the lower body of the chair base and a set of horizontal planes form a set of contour lines where:

one or more lower contour lines are transversely elongated elliptical shapes, one or more intermediate contour lines are quasi rectangular shapes with rounded corners and straighter longitudinal and transverse sections, and one or more upper contour lines are forward and aft segments that intersect the chair base sides and are straighter and more parallel to the chair ends than the intermediate contour lines.

* * * * *